US010174545B2

(12) United States Patent
Janick et al.

(10) Patent No.: US 10,174,545 B2
(45) Date of Patent: Jan. 8, 2019

(54) FABRIC FIRE RATED DOOR

(71) Applicant: CIW Enterprises, Inc., Mountain Top, PA (US)

(72) Inventors: James Janick, Shavertown, PA (US); Brian Feist, Mountain Top, PA (US); David Dawdy, Mountain Top, PA (US); Ian Klish, Nanticoke, PA (US)

(73) Assignee: CornellCookson, LLC, Mountaintop, PA (US)

( * ) Notice: Subject to any disclaimer, the term of this patent is extended or adjusted under 35 U.S.C. 154(b) by 2 days.

(21) Appl. No.: 15/429,370

(22) Filed: Feb. 10, 2017

(65) Prior Publication Data

US 2017/0234061 A1 Aug. 17, 2017

Related U.S. Application Data

(60) Provisional application No. 62/294,582, filed on Feb. 12, 2016, provisional application No. 62/372,141, filed on Aug. 8, 2016.

(51) Int. Cl.

| | |
|---|---|
| ***A62C 2/10*** | (2006.01) |
| ***A62C 2/18*** | (2006.01) |
| ***E06B 3/80*** | (2006.01) |
| ***E06B 5/16*** | (2006.01) |
| ***E06B 9/13*** | (2006.01) |

(Continued)

(52) U.S. Cl.

CPC ..... *E06B 9/17* (2013.01); *A62C 2/10* (2013.01); *A62C 2/18* (2013.01); *E06B 5/16* (2013.01); *E06B 9/13* (2013.01); *E06B 9/171* (2013.01); *E06B 9/17046* (2013.01); *E06B 9/58* (2013.01); *E06B 9/80* (2013.01); *E06B 3/80* (2013.01);

(Continued)

(58) Field of Classification Search

CPC ..... E06B 9/17; E06B 5/16; E06B 9/17046; E06B 9/581; E06B 9/62; E06B 9/72; E06B 9/80; E06B 3/80; E06B 2009/801

See application file for complete search history.

(56) References Cited

U.S. PATENT DOCUMENTS 4,095,642 A * 6/1978 McKinnon ..... E06B 3/80 160/332
4,478,268 A * 10/1984 Palmer ..... B65G 69/008 160/272

(Continued)

FOREIGN PATENT DOCUMENTS

| | | |
|---|---|---|
| EP | 0989280 A1 | 3/2000 |
| EP | 2107205 A2 | 10/2009 |
| EP | 2169173 A1 | 3/2010 |

*Primary Examiner* — Brian D Mattei
(74) *Attorney, Agent, or Firm* — Mitchell A. Smolow

(57) ABSTRACT

A fabric fire rated door is described. The door utilizes a fire resistant fabric curtain with an end lock attachment. A tubular steel shaft is driven by an internal tube motor. The shaft is supported to minimize deflection. Single door shafts can also be joined together with a coupler shaft to create infinitely wide doors. The coupler shaft is spring loaded to act as a take up reel for a coupling curtain which will overlap each adjacent single door shaft. All curtains are attached to the same bottom bar. A hood covers the shaft, curtain, and the supports that run across the width of the door. The curtain travels over these horizontal supports as it drops down through the hood opening. The horizontal supports keep the curtain in position for proper seal during a fire/smoke event.

23 Claims, 15 Drawing Sheets

(51) Int. Cl.

| | |
|---|---|
| ***E06B 9/17*** | (2006.01) |
| ***E06B 9/58*** | (2006.01) |
| ***E06B 9/80*** | (2006.01) |
| ***E06B 9/171*** | (2006.01) |
| ***E06B 9/174*** | (2006.01) |

(52) U.S. Cl.
CPC . *E06B 2009/1746* (2013.01); *E06B 2009/587* (2013.01); *E06B 2009/801* (2013.01)

(56) References Cited

U.S. PATENT DOCUMENTS 5,139,075 A 8/1992 Desrochers
5,427,169 A * 6/1995 Saulters ..... E06B 3/80 160/332
5,632,317 A 5/1997 Krupke et al.
5,743,320 A 4/1998 McKeon
5,765,622 A 6/1998 Lichy
5,809,699 A 9/1998 Joly
5,812,391 A 9/1998 Mehalshick
6,021,837 A 2/2000 Miller
6,068,040 A * 5/2000 Magro ..... E06B 9/581 160/133
6,070,640 A * 6/2000 Miyagawa ..... A62C 2/10 160/121.1
6,138,739 A 10/2000 Crider et al.
6,152,207 A 11/2000 Varley
6,155,327 A 12/2000 Wells et al.
6,176,050 B1 1/2001 Gower
6,412,538 B1 7/2002 Welfonder
6,705,378 B1 3/2004 Smidt
6,942,003 B2 9/2005 Thompson
6,959,518 B2 11/2005 Cousin
6,962,188 B2 11/2005 Coenraets
7,028,742 B2 4/2006 Sears et al.
7,131,481 B2 11/2006 Varley et al.
7,152,653 B1 12/2006 Kubly et al.
7,610,719 B2 11/2009 Hsieh
7,730,930 B2 6/2010 Malausa et al.
7,735,539 B2 6/2010 Nakamura et al.
7,810,576 B2 10/2010 Reick
7,900,408 B2 3/2011 Holland et al.
8,037,921 B2 10/2011 Dondlinger et al.
8,113,266 B2 2/2012 Cloninger et al.
8,251,118 B2 8/2012 Loar
8,291,960 B2 10/2012 Bowman
8,443,909 B2 5/2013 Wong
8,789,576 B2 7/2014 Krueger et al.
8,919,415 B1 12/2014 Crider
8,931,540 B2 1/2015 Filko
8,950,461 B2 2/2015 Adams et al.
9,127,501 B1 9/2015 Stoblich et al.
9,133,663 B2 9/2015 Klish et al.
2003/0188837 A1* 10/2003 Varley ..... E06B 9/13 160/264
2005/0211398 A1* 9/2005 Coenraets ..... E06B 9/581 160/271
2009/0008039 A1* 1/2009 Lambridis ..... A62C 2/10 160/121.1
2010/0101740 A1 4/2010 di Stefano
2011/0253323 A1* 10/2011 Bowman ..... E06B 9/13 160/309
2012/0247692 A1 10/2012 Panseri et al.
2013/0228289 A1* 9/2013 Klish ..... E06B 9/82 160/7
2013/0306252 A1* 11/2013 Lambridis ..... E06B 9/13 160/133
2014/0014281 A1 1/2014 Mullet et al.
2014/0158313 A1 6/2014 McTavish et al.
2014/0230334 A1* 8/2014 Janick ..... E06B 9/17046 49/460
2014/0231032 A1* 8/2014 Blair ..... E06B 9/42 160/310
2014/0262067 A1* 9/2014 Higgins ..... E06B 9/174 160/120
2014/0333848 A1 11/2014 Chen
2014/0374035 A1 12/2014 Drifka et al.
2015/0128502 A1* 5/2015 Janick ..... E06B 9/17046 49/460
2015/0136334 A1 5/2015 Ballester
2015/0231427 A1 8/2015 Coopers et al.
2015/0376897 A1 12/2015 Bigelow
2016/0348424 A1* 12/2016 Lorenzani ..... E06B 9/13
2017/0107760 A1* 4/2017 Campagna ..... E06B 9/60
2017/0138118 A1* 5/2017 Wong ..... E06B 5/16

* cited by examiner

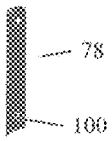
FLG 24
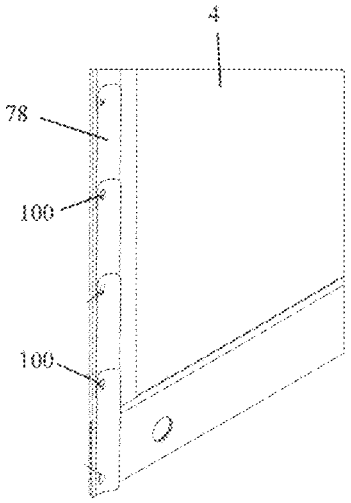
FIG. 25
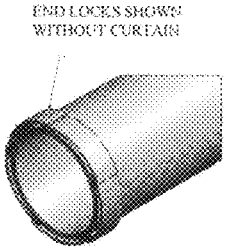
FIG. 26
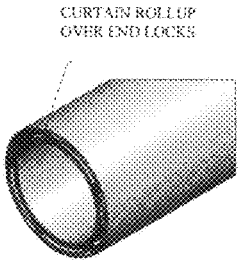
FIG. 27
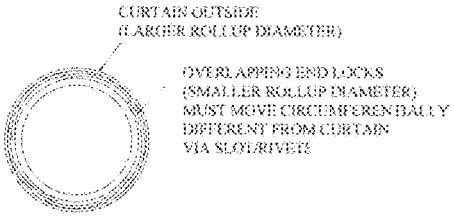
FIG. 28

FABRIC FIRE RATED DOOR

CROSS REFERENCE TO RELATED APPLICATIONS

This application claims benefit of U.S. Provisional Application No. 62/294,582 filed Feb. 12, 2016, U.S. Provisional Application No. 62/372,141 filed Aug. 8, 2016, and PCT application PCT/US17/13501 filed Jan. 13, 2017.

FIELD OF THE INVENTION

This invention relates generally to fire and smoke protection, and in particular, to a fabric coiling door product used as a rated passive fire protection and smoke barrier assembly.

BACKGROUND OF THE INVENTION

By code, buildings such as industrial, school and public buildings require fire and smoke barrier opening protectives. Due to the simplistic operation and known designs of swing door exit hardware, side-hinged swinging doors are commonly used.

However, code rated side-hinged swinging doors are not always the desired design choice to meet code requirements. For structures needing higher occupancy fire/smoke protection requirements, multiple swing doors and/or banks of swing doors and their associated frame assemblies are used. The framing requirements of multiple doors and/or banks of doors present architectural challenges for building designers.

In an attempt to overcome these challenges, a variety of door designs have been developed. One known design uses up to two swinging fire door and frame assemblies that store in pockets perpendicular to the opening. A second known design includes a bank of swinging fire door and frame assemblies that are attached to the bottom of a coiling door. Although these designs include commonly accepted side-hinge swinging doors, they require significantly more head or side room clearances and cost more to manufacture than earlier designs.

Another known design uses commonly accepted side-hinge swinging doors in an accordion folding fire door configuration. However, this design requires side stack space for the folded accordion door and non-folding side-hinge swinging door(s). Because occupancy load determines the amount of door opening/number of required doors, each required side-hinge swinging door mandates additional side stack space, thereby reducing the overall free space and presenting construction challenges.

Accordingly, there remains a continuing need for improved combined emergency egress and fire/smoke barrier designs. The present invention fulfills this need and further provides related advantages.

BRIEF SUMMARY OF THE INVENTION

Described below is an electrically operated, vertically deployed, UL10D tested fabric coiling door product that may be used as a rated passive fire protection and smoke barrier assembly. It targets, for example, atrium closures to project smoke layers to lower floors, form protected atrium evacuation pathways and provide an alternative basis to lower or eliminate smoke evacuation system requirements.

The door utilizes a fire resistant fabric curtain, for example, a fiberglass based fabric curtain with thermal coating. In a preferred embodiment the curtain is stitched together with strip steel bands sewn in to each end for end lock attachment. End locks can be, for example, L-shape brackets or segments of curved spring steel. A third steel band is sewn in across the top for attachment of the curtain to the shaft. Brackets are riveted to the top band and the brackets are then bolted to the shaft, or alternatively, the band is slotted for side to side adjustment and bolted directly to the shaft. Curtains can be attached to the shaft in overlapping segments for easy installation. The overlapping segments are sealed to each other, for example, with a fire rated hook and loop material that is sewn to the curtains.

The tubular steel shaft is driven by an internal tube motor which provides governing to maintain consistent closing speeds. In a fire/smoke event or loss of power, the door will automatically close via gravity. The shaft can be segmented for easier installation. Segments have male/female ends and bolt together. Single/segmented shafts can extend to approximately 50 feet and are driven by a tube motor at each end. The shaft is supported approximately every 6 feet to minimize deflection. Support brackets are designed to attach to the header and employ rollers for the shaft to ride on during operation. Single door shafts can also be joined together with a coupler shaft to create infinitely wide doors. The coupler shaft is spring loaded to act as a take up reel for the coupling curtain which will overlap each adjacent single door shaft. All curtains are attached to the same bottom bar.

A sheet metal hood covers the shaft, curtain, and the supports that run across the width of the door. The curtain travels over these horizontal supports as it drops down through the hood opening. The horizontal supports keep the curtain in position for proper seal during fire/smoke event.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIG. 24 is a perspective view of a curved end lock.

FIG. 25 is a perspective view of curved end locks on a curtain.

FIGS. 26 and 27 are perspective views of end locks rolled-up.

FIG. 28 is an end view of end locks rolled-up.

Figure 1:
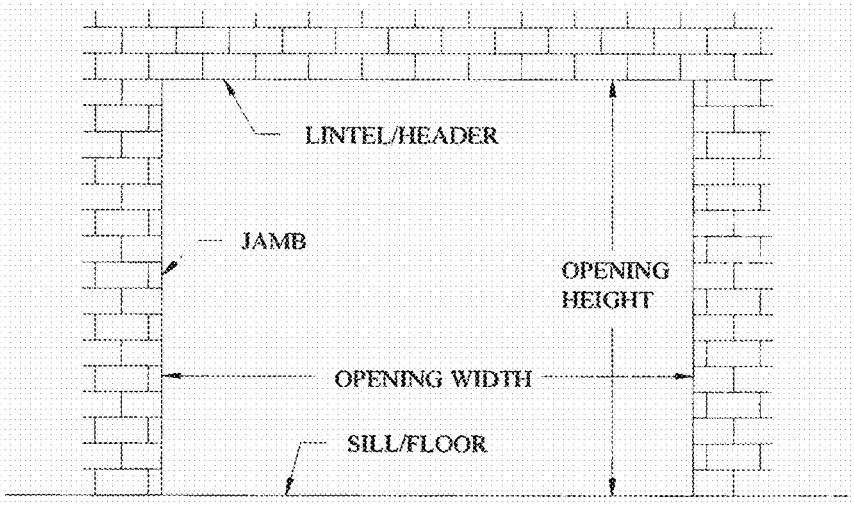
FIG. 1 is a view of an atrium opening.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

For purposes of this disclosure, a smoke protective state is meant to be when the curtain(s) are closed to create a fire and smoke barrier during a fire/smoke event.

Turning now to the figures, the fabric fire rated door system is a vertically coiling fire and smoke containment system that is comprised of a fire resistant curtain or curtains, for example operational assembly curtains 4 and a coupling curtain 40, vertically oriented side members 6, for example, a guide, a counterbalance assembly 8 and an operational assembly 10. The counterbalance assembly 8 and operational assembly 10 are preferably contained within an overhead hood 12.

Figure 21:
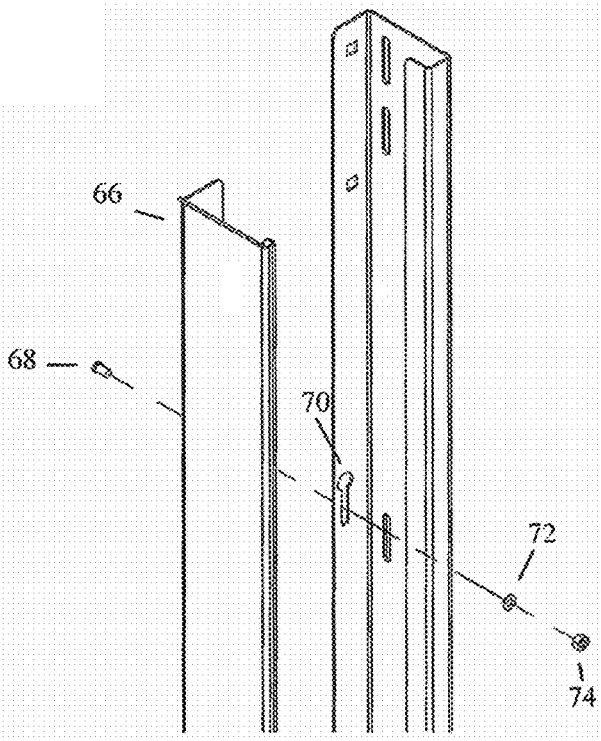
FIG. 21 is a perspective view of a second form of curtain side geometry.
Figure 22:
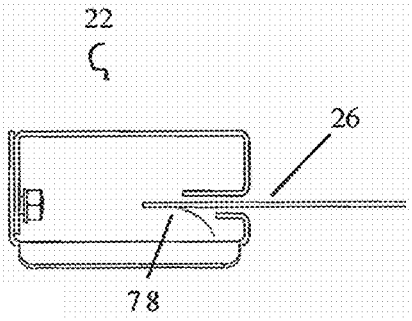
FIG. 22 is a top view of the curtain side geometry of FIG. 21.
Figure 23:
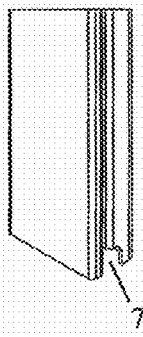
FIG. 23 is perspective view of the tool cutout of the curtain side geometry of FIG. 21.

The counterbalance assembly 8 comprises a counterbalance barrel, for example, a shaft 14, which is supported above the opening and secured by horizontal support members, for example, brackets 16 and end plates 18. The curtain 4 directly attaches to the shaft 14 and rolls onto and off of the shaft 14 as the shaft 14 is rotated by the operational assembly 10. The operational assembly curtain 4 travels within the vertically oriented side members 6, within which the outer edges 20 of the operational assembly curtain 4 are contained and guided. In a preferred embodiment, the operational assembly curtain outer edges 20 comprise side geometries 22 (FIGS. 19 and 21) which are mechanically locked within the vertically oriented side members 6.

The operational assembly 10 comprises a drive motor assembly 11 and a releasing device 46, for example, a tube motor with internal brake. Optionally a controller and a continuously charged battery backup power supply (shown collectively as 47, FIG. 11) is included. In a preferred embodiment the shaft 14 is a tubular shaft driven by an internal tube motor 11 which provides governing to maintain consistent closing speeds. During a predetermined condition such as a fire/smoke event or loss of power, the door will automatically close via gravity upon activation of the releasing device 46, for example, release of the brake.

In the preferred embodiment the tube motor 11 is fully constrained at the end plate 18 and the shaft 14 is allowed to deflect as the curtain unrolls and the diameter decreases. In this embodiment a horizontal support member, for example, roller brackets 16 consistently support the shaft 14 across the door opening, and in particular, at elevated temperatures, for example, during a fire.

Figure 5:
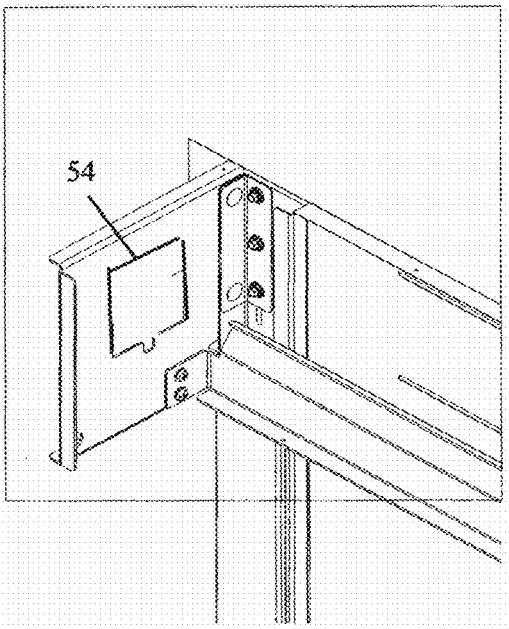
FIG. 5 is another perspective view of an end plate.

In an alternate embodiment a slot 54 (FIG. 5) is added to the end plate 18 to allow the tube motor to slide up and down as the rolled/unrolled curtain 14 gets larger or smaller. Additionally, a roller bracket 16 may be added next to the end plate 18 to support a curtain rollup at its end. At the end plates 18 the shaft 14 will remain straight instead of deflecting as the curtain 14 unrolls.

The operational assembly 10 is designed to function under normal or test conditions with, for example, a secured or unsecured Open/Close/Stop station 49. The controller is programmed to automatically deploy the curtain upon entering an alarm condition, for example, receiving notification from a building fire alarm control panel, local fire and/or smoke detection appliances, or upon a pre-determined reduction of available power, for example, battery power.

Figure 4A:
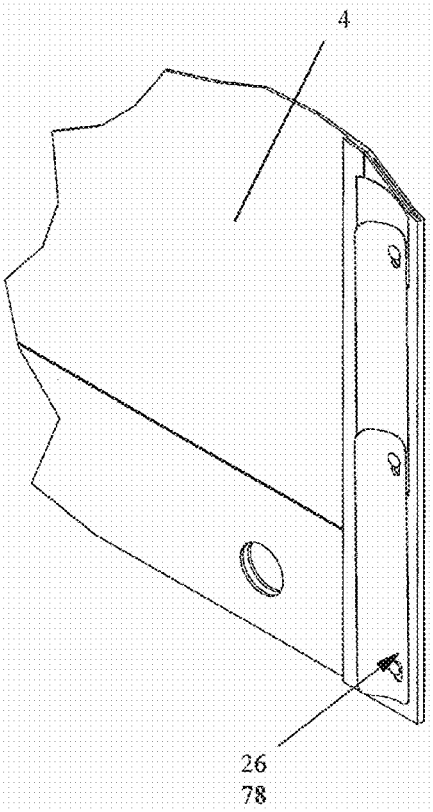
FIGS. 4*a* and 4*b* are perspective views of a curtain bottom corner.
Figure 4B:
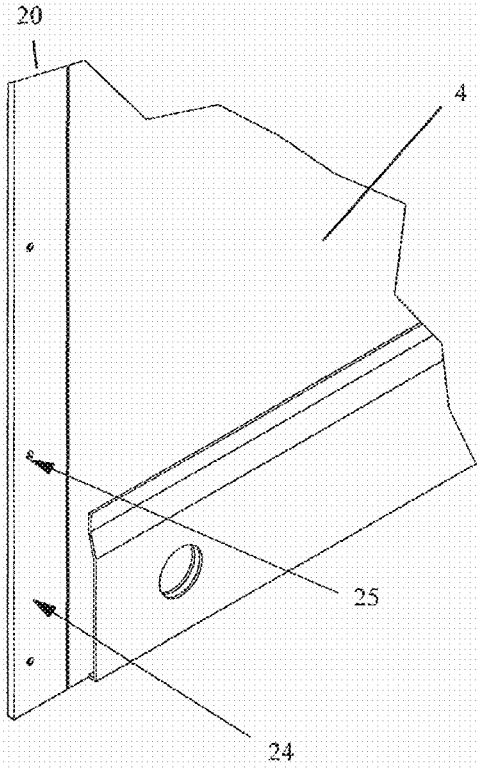

The curtains 4, 40 comprise a fire resistant fabric, for example, a fiberglass based fabric curtain with thermal coating. In a preferred embodiment the operational assembly curtain 4 is stitched together with side strip steel bands 24 sewn in to each curtain outer edge 20 for attachment of an end lock 26, 78 (FIGS. 4*a*, 4*b*, 25). The end lock 26 can be, for example, L-shape brackets or segments of curved spring steel. The end lock 26 is fastened to the side strip steel band 24 with fasteners 25, for example, rivets.

Figure 12:
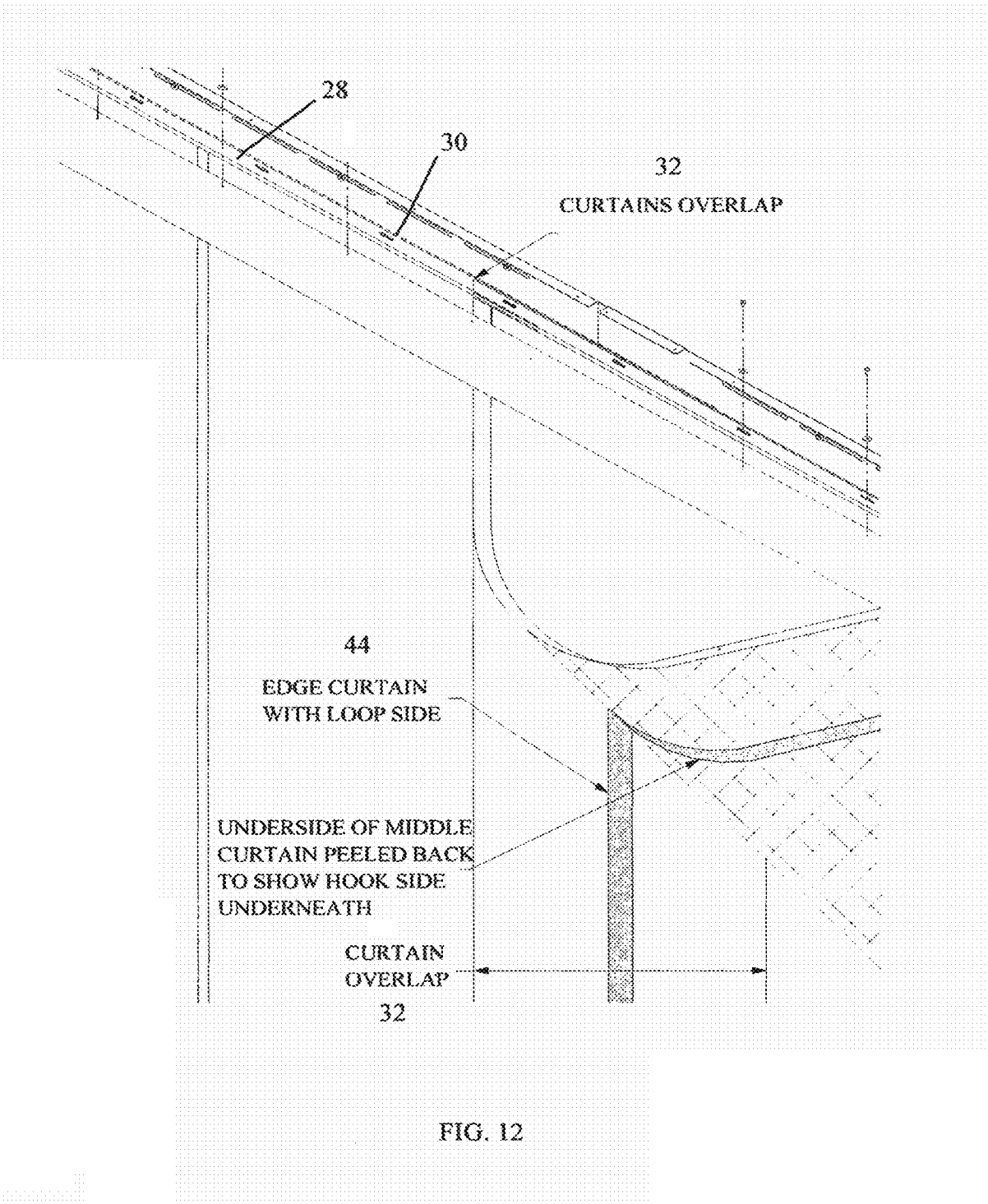
FIG. 12 is a perspective view of curtain overlap.
Figure 13:
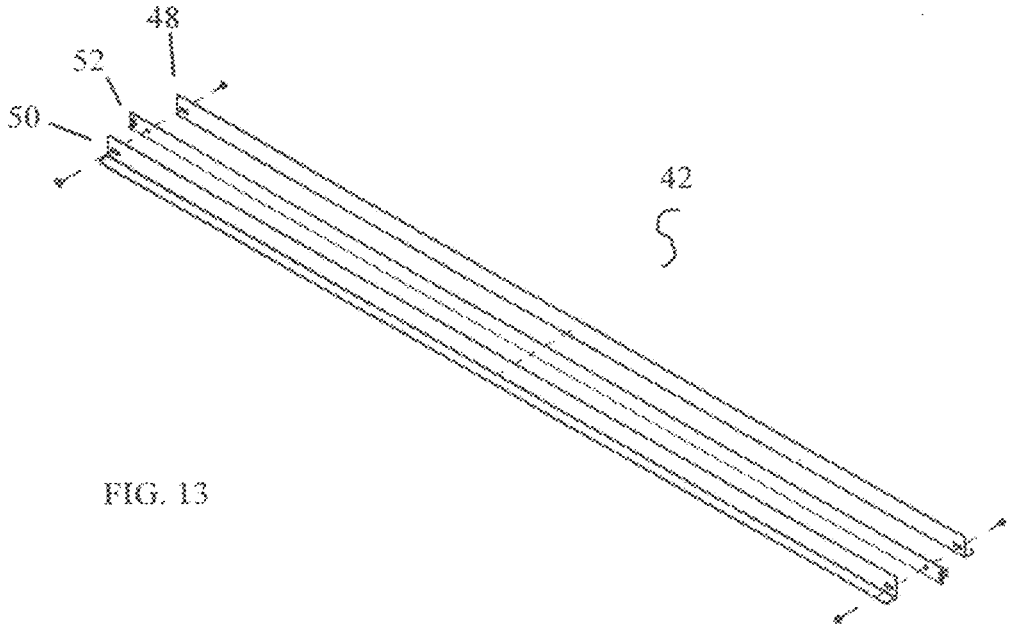
FIGS. 13-18 are perspective views of a bottom bar assembly.

Depicted in FIG. 12, a top strip steel band 28 is sewn into the curtain top 30 and used to attach the curtain 4, 40 to the shaft 14. In one form brackets are fastened to the top strip steel band 28 and the brackets are then bolted to the shaft 14. Curtains 4 can be attached to the shaft 14 in overlapping segments 32, for example, every 3 feet, for easy installation. The overlapping segments 32 are sealed to each other, for example, with a fire rated hook and loop material 44 that is sewn to the curtains 14.

Figure 6:
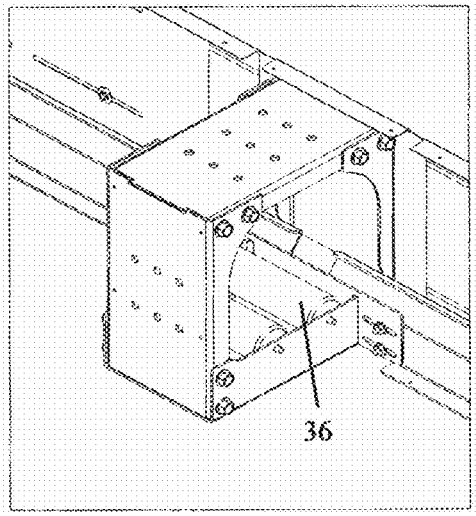
FIGS. 6 and 7 are a perspective views of a bracket.
Figure 7:
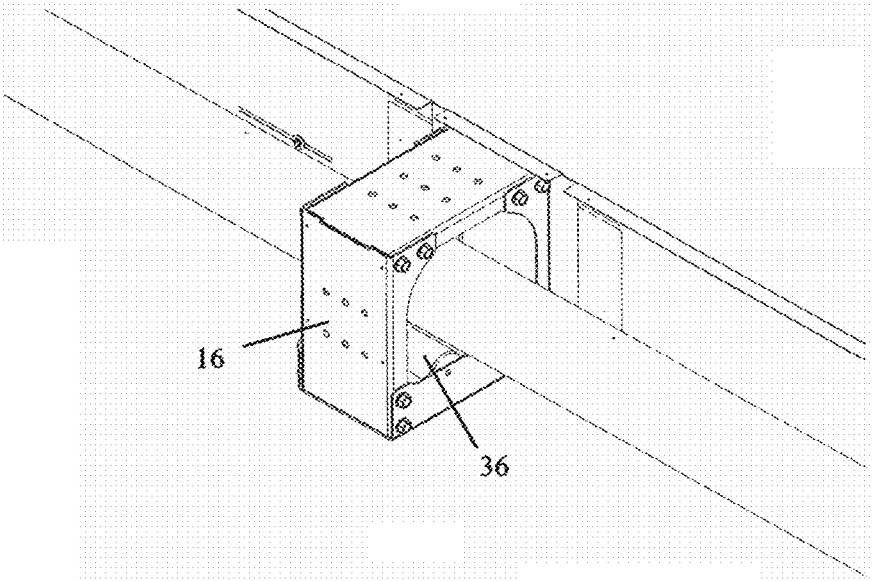
Figure 8:
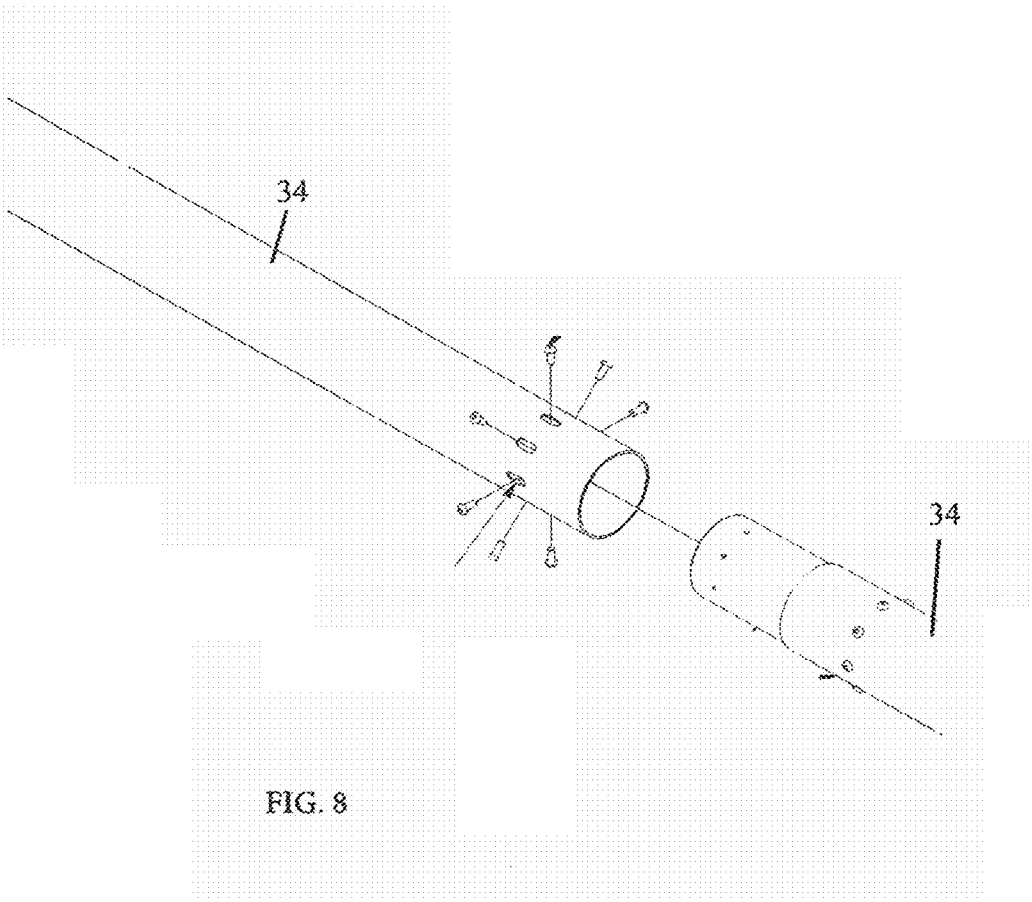
FIG. 8 is a perspective view of two shafts.

Depicted in FIG. 8, the shaft 15 can be segmented for easier installation. The shaft segments 34 are joined. For example, the shaft segments 34 comprise male/female ends and bolt together. Preferably, single/segmented shafts 14 can extend to approximately 50 feet and may be driven by a tube motor 11 at each end. The shaft 14 requires support approximately every 8 feet to minimize deflection. Horizontal support members, for example, shaft support brackets 16 are designed to attach to the header and employ rollers 36 (FIG. 6) for the shaft 14 to ride on during operation.

Figure 9:
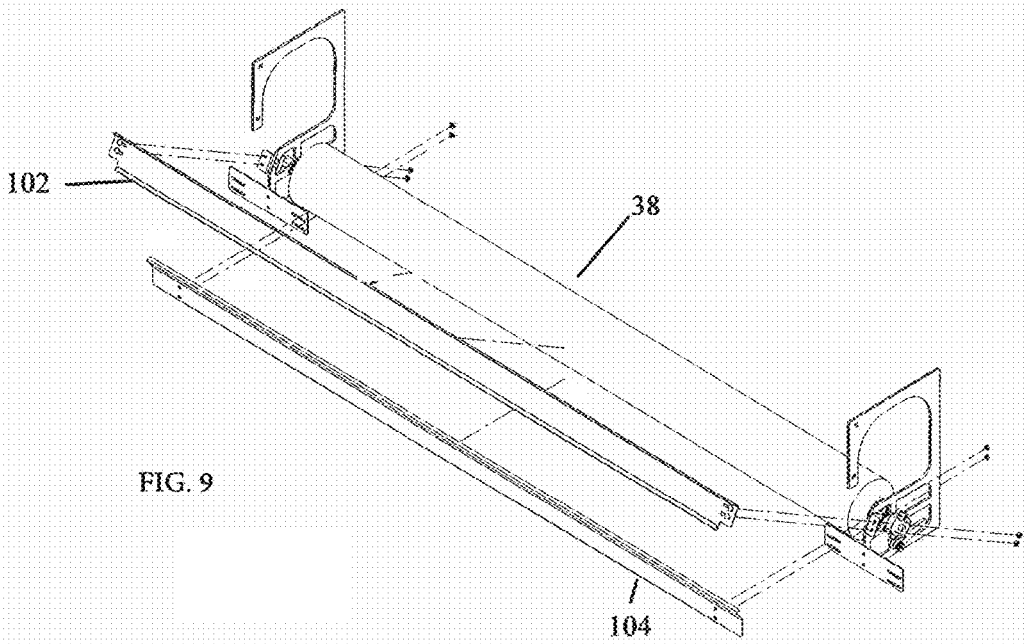
FIGS. 9 and 10 are perspective views of a coupling curtain.
Figure 10:
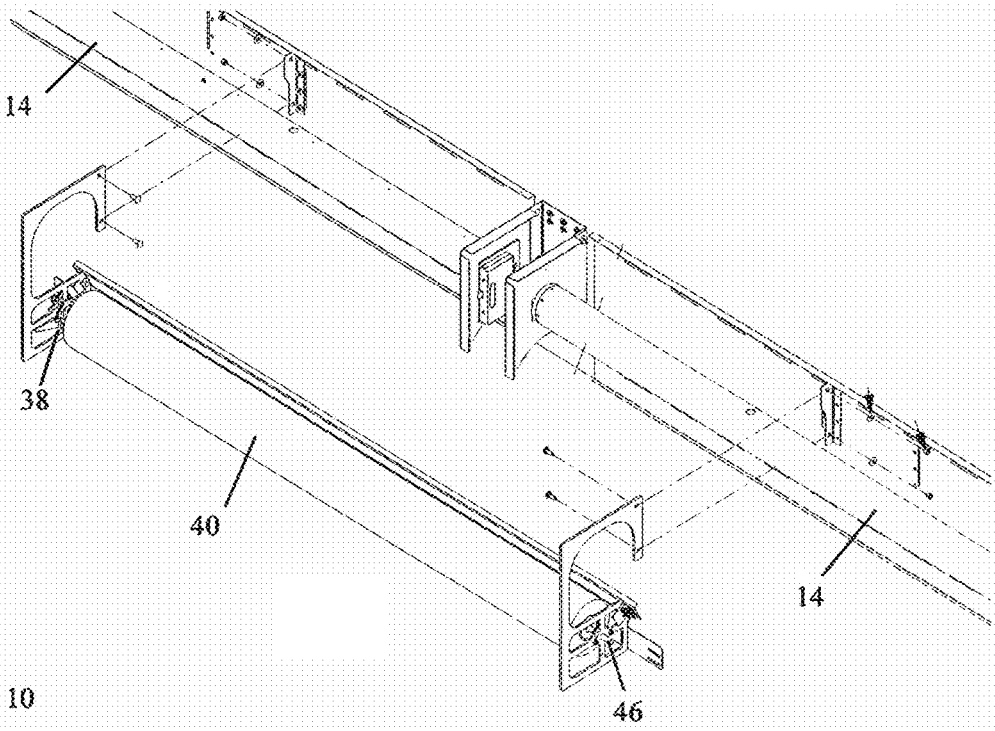
Figure 11:
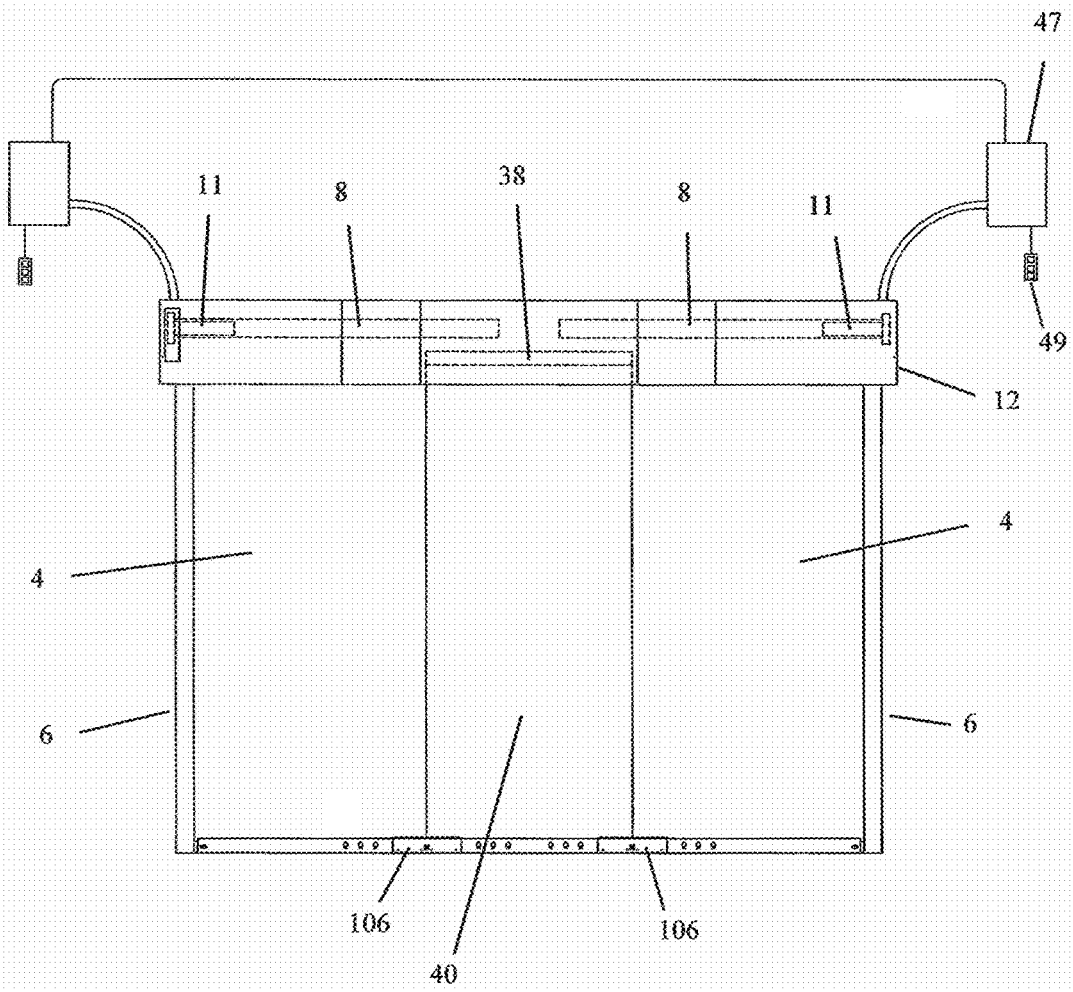
FIG. 11 is a front view of a door with coupling curtain.

As shown in FIGS. 9-11, door curtains can be joined together with a coupler shaft 38 comprising a hook and loop separator channel 102 and coupling curtain cross brace 104 to create infinitely wide doors. The coupler shaft 38 is not motor driven, but rather it is spring loaded to act as a take up reel for a coupling curtain 40 which will overlap each adjacent curtain 14 and its respective shaft 14 by about 3 feet.

Preferably, the coupler shaft 38 is a smaller, spring loaded shaft used together with its coupling curtain 40 to connect two adjacent operational assembly curtains 4. The coupler shaft 38 is spring loaded with enough force to separate the hook and loop material 44 as it winds and acts as take up reel for the coupling curtain 40 (depicted as rolled-up in FIG. 10). In this configuration all operational assembly curtains 4 and coupling curtains 40 are attached to the same bottom bar assembly 42, described in detail below.

The hood 12 is preferably a sheet metal hood which covers the shaft 14, curtain 4, 40, and support brackets 16. Inside of the hood 12 are the horizontal supports that run across the width of the door opening. They comprise the end plates 18 and the support brackets 16. The operational assembly curtain 4 travels over these horizontal supports as it drops down through the hood opening. The horizontal supports keep the curtain in position to maintain an effective seal during a smoke protective state.

Turning to FIGS. 13-18, the bottom bar assembly 42, comprises, for example, a first angle bottom bar 48 and a second angle bottom bar 50 with a bottom bar center flat section 52 therebetween. The operational assembly curtain 4 and coupling curtain 40 are secured to the bottom bar flat section 52, for example, by inserting the bottom bar flat section 52 into a curtain bottom hem pocket 108. The bottom bar flat section 52 is fixed, for example, pinned, to the first and second angle bottom bars 48, 50 at each end. Preferably, the first and second angle bottom bars 48, 50 remain outside of the curtain bottom hem pocket 108.

This configuration allows the bottom bar center flat section 52 to deflect vertically in the center of the door between the first and second angle bottom bars 48, 50. This will allow the operational assembly curtain 4 and coupling curtain 40 to move during a smoke protective state without breaching the fire and smoke barrier when pressure is applied from air temperature change during a fire. The configuration prevents the bottom bar center flat section 52 to which the operational assembly curtain 4 and coupling curtain 40 are attached from deflecting far enough to "pop out" of or no longer be contained within the first and second angle bottom bars, thereby preventing creation of an opening which would allow smoke to pass. Containment of smoke is critical for a fire rated product.

Figure 14:
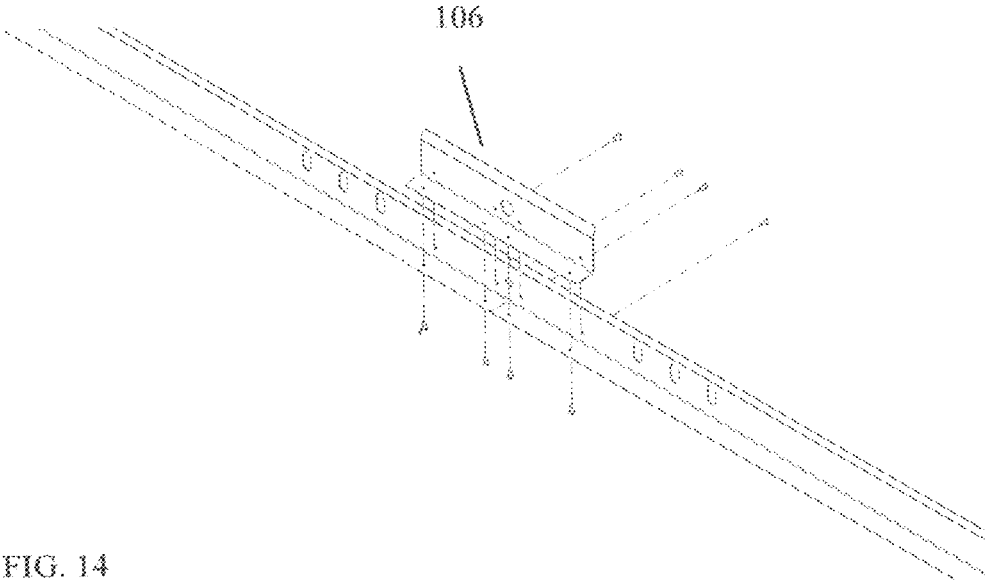
Figure 15:
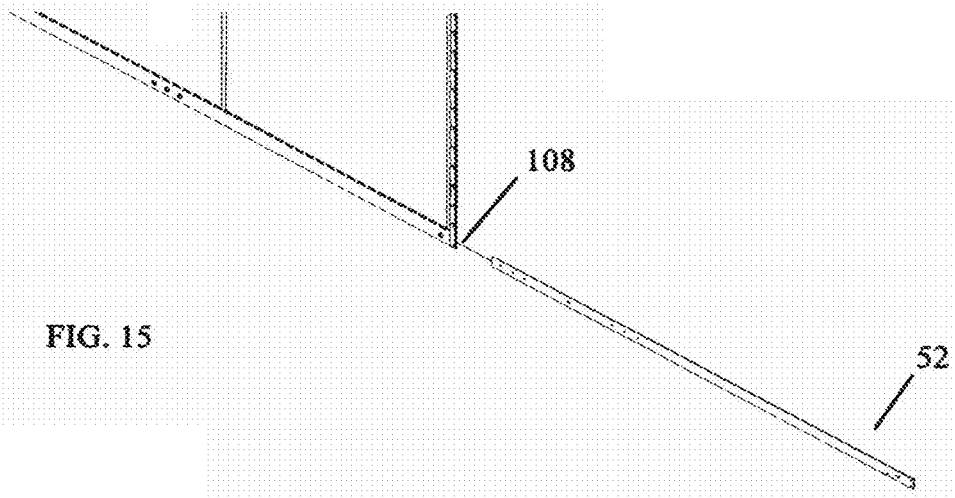
Figure 16:
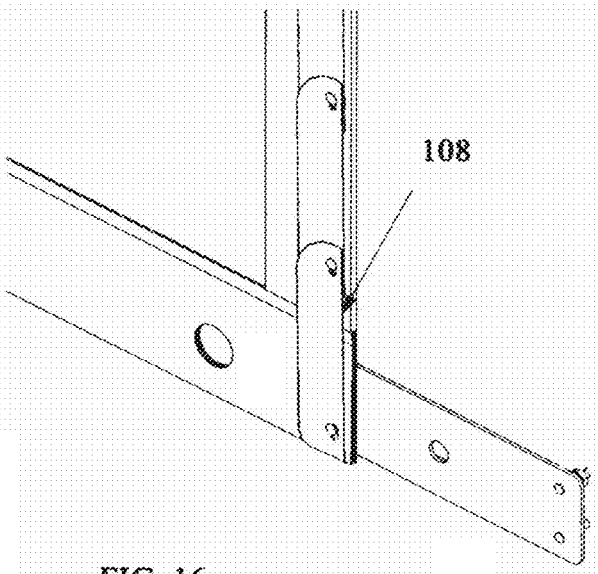
Figure 17:
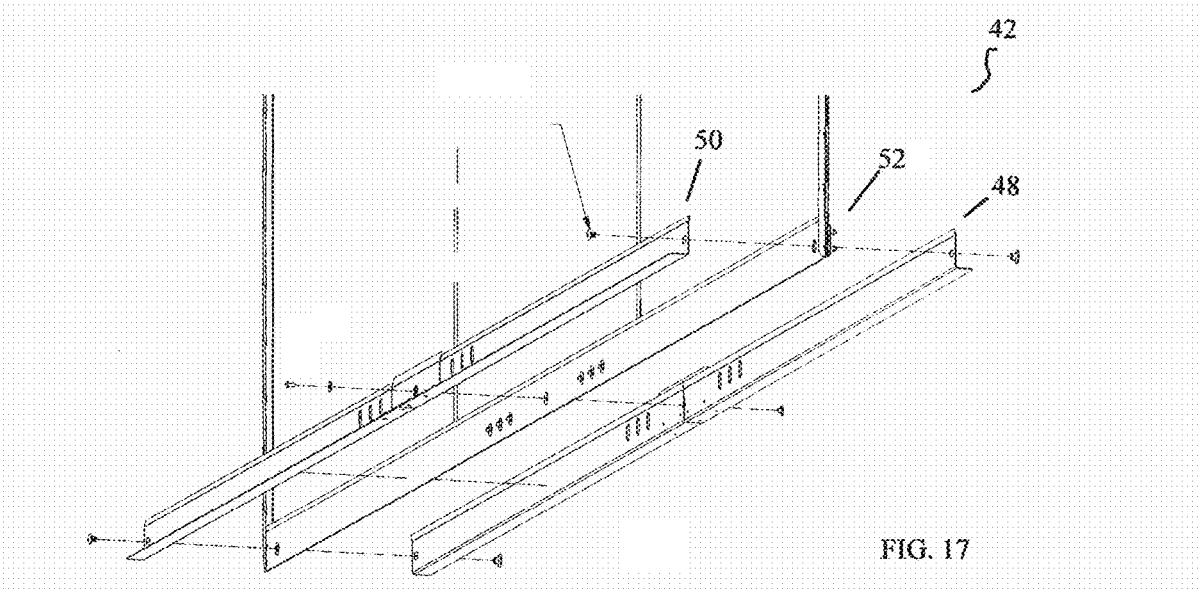
Figure 18:
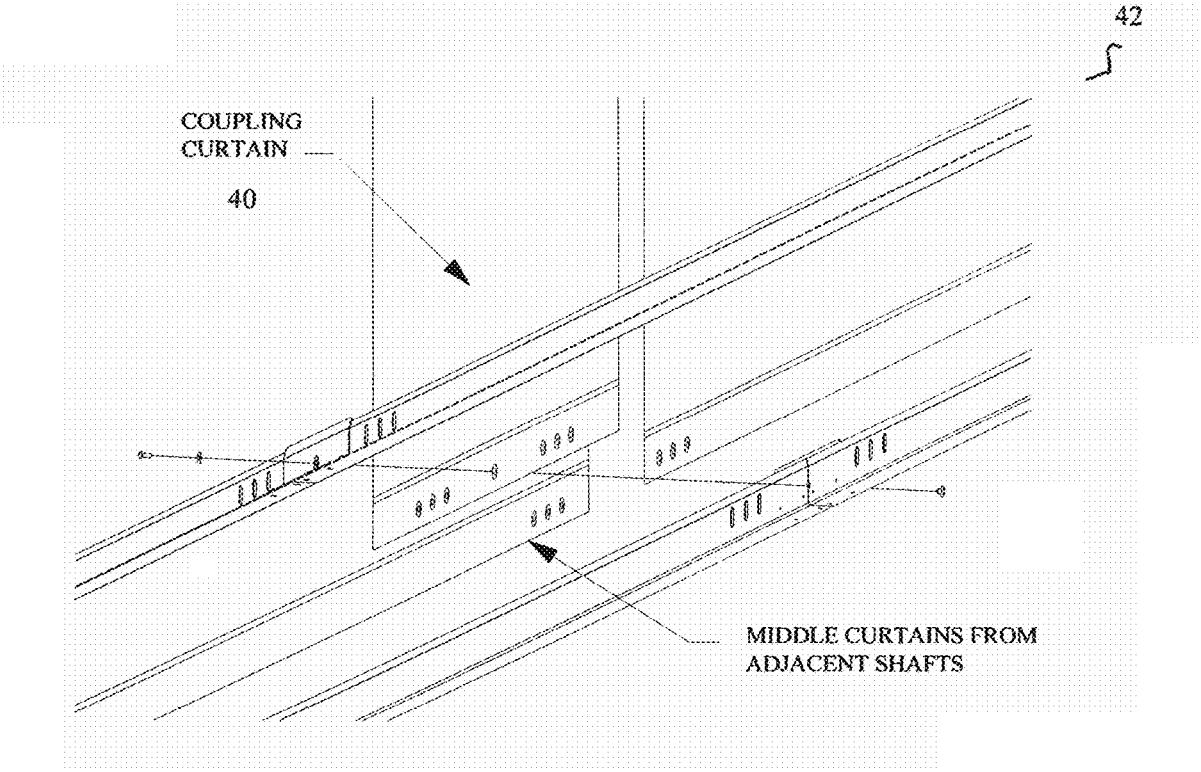

If necessary to meet larger width openings, multiple angle bottom bars are joined with an angle bottom bar connector 106 (FIGS. 11 and 14). If multiple bottom bar center flat sections 52 are required they are overlapped inside of the curtain bottom hem pocket 108. FIG. 17 depicts the bottom bar assembly 42 attachment and FIG. 18 depicts the bottom bar assembly 42 attachment when a coupling curtain 40 is utilized. In both figures the curtains are depicted as transparent.

Figure 19:
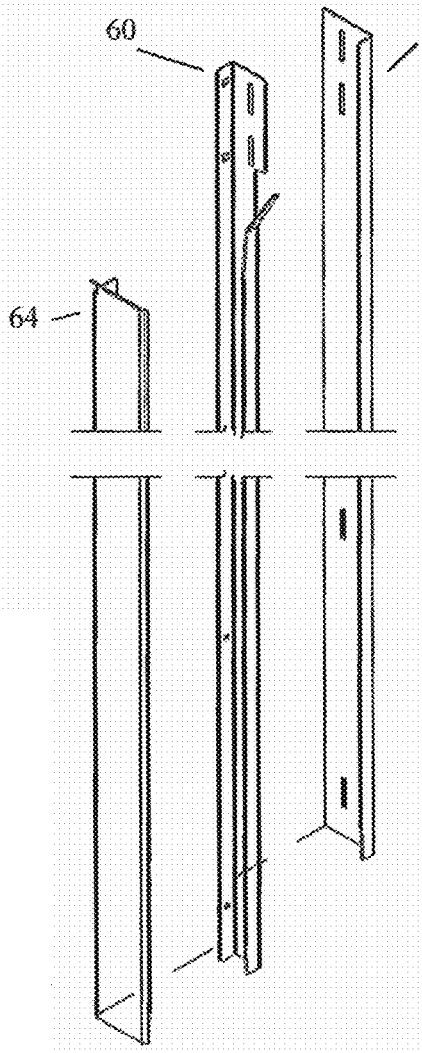
FIG. 19 is a perspective view of one form of a curtain side geometry.
Figure 20:
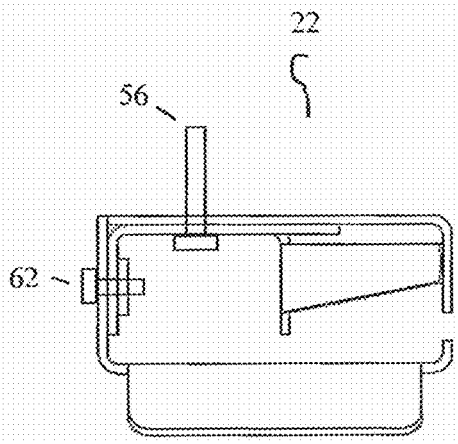
FIG. 20 is a top view of the curtain side geometry of FIG. 19.

Turning now to FIGS. 19-20, one form of operational assembly curtain side geometry 22 comprises a three piece guide used for L-shaped end retention. A fascia fastener 56 attaches a fascia guide 58 and an inner guide 60 to a wall. An outer guide fastener 62 attaches an outer guide 64 to the inner guide 60, for example, with a screw to an inner guide weld stud or threaded hole.

Alternatively, as shown in FIGS. 21-25, a two piece guide utilizing press in studs for a "no fastener" appearance is used with a curved band retention system. The outer guide 66 with a press in stud 68 slides onto inner guide slots 70 with washer 72 and a nut 74 loosely attached. The installer can then use a nut driver to tighten the fasteners. A cutout 76 at the bottom of the guide assembly allows insertion of the tool.

Curved end locks 78 are attached to the curtain 4, for example, in about 5 inch segments. Depicted in FIGS. 26-28, as the curtain 14 rolls up, the curved end locks 78 flatten out to roll up similar to a tape measure. End lock slots 100 allow circumferential movement to account for different diameters in material as the curtain 14 rolls up. For example, when the curtain 14 is about ⅛ inch thick and rolls on top of the end locks 78, the end locks 78 roll up on a tighter diameter than the curtain 14, and therefore, the end locks 78 have to move independent of the curtain 14. This allows for a tighter roll-up on the shaft 14 and less chance for the end locks 78 to catch on something thereby preventing the curtain 14 from closing.

Figure 29:
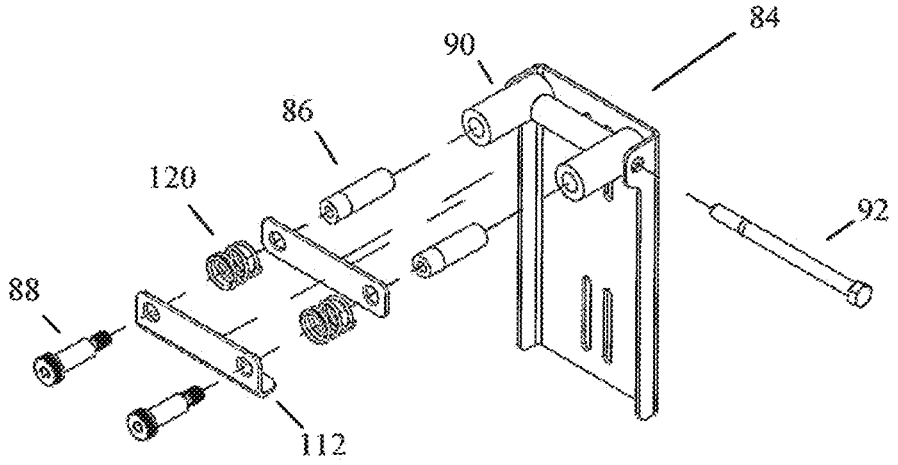
FIG. 29 is an exploded perspective view of a shaft stop mechanism.
Figure 30:
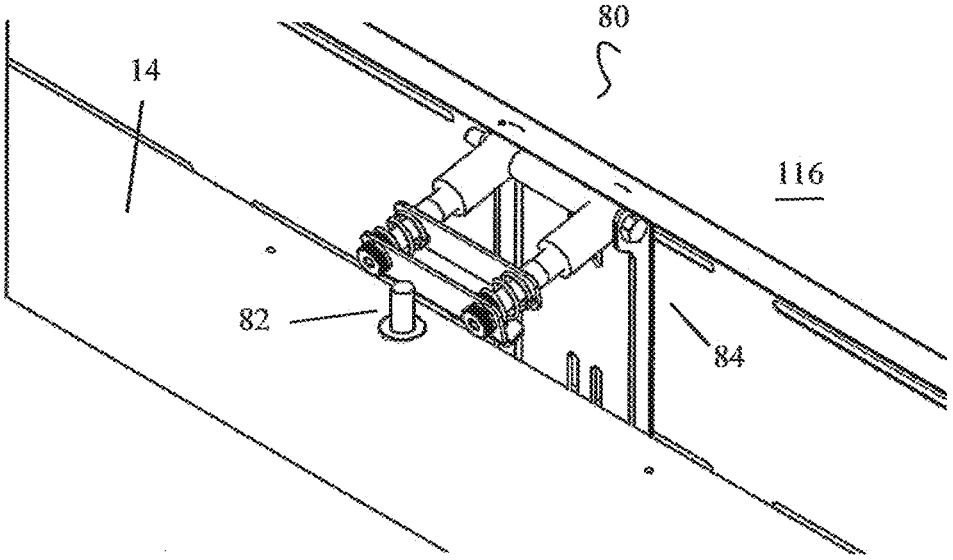
FIG. 30 is a perspective view of a curtain stop assembly.

A curtain stop assembly 80 is shown in FIGS. 29-30. A spring loaded pin 82 is installed inside of the shaft 14 and can extend out from the shaft 14 when the door is closed and the curtain 14 unwraps, thereby uncovering the pin 82. The pin 82 will then stop the shaft 14 from rotating when it hits a shaft stop mechanism 84 mounted directly or indirectly to the building structure 116.

Preferably, the shaft stop mechanism 84 is also spring-loaded 120 to absorb impact. In one form a threaded tube 86 accepts shoulder bolts 88 and threads into larger tubes 90 that rotate on a main pivot bolt 92. The shoulder bolts 88 can be used to rotate the tube and adjust the shaft stop plate 112 in and out to modify curtain tension.

Figure 2:
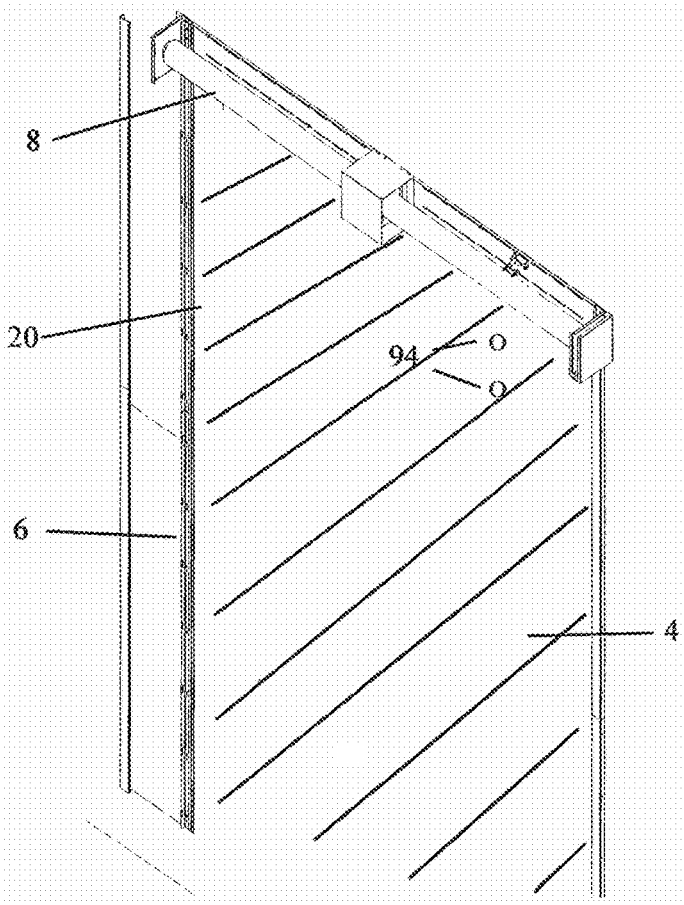
FIG. 2 is a perspective view of an unrolled curtain.
Figure 3:
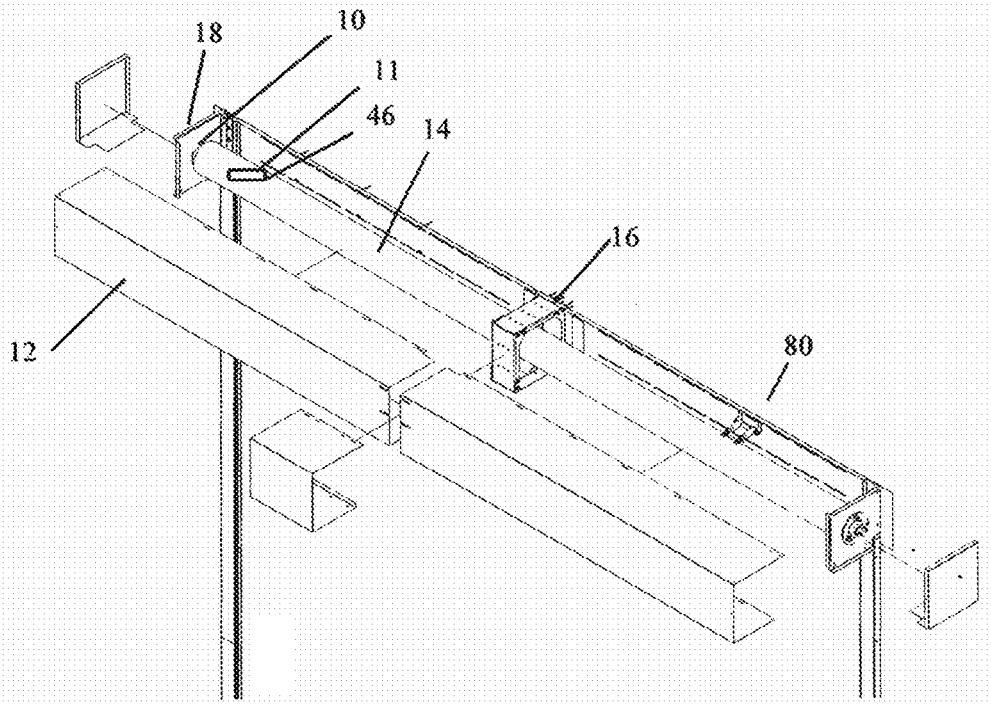
FIG. 3 is a perspective view of a hood.

Optionally, when it is desirable that the curtain 14 not fully unwind, one or more curtain slots 94 (FIG. 2) are fabricated into the curtain 14 at a predetermined location(s) to allow the spring loaded pin 82 to extend through the curtain 14 before the curtain 14 fully unwinds.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A door system comprising:

an operational assembly curtain comprising a bottom bar assembly, the operational assembly curtain retained within vertically oriented side members by a respective operational assembly curtain side geometry and retained within the bottom bar assembly upon application of a pressure;

a counterbalance assembly fixed to the operational assembly curtain; and an operational assembly to operate the counterbalance assembly;

wherein, the bottom bar assembly comprises:

a first angle bottom bar;

a second angle bottom bar; and a bottom bar center flat section therebetween; wherein the center flat section deflects vertically in a center of the door system between the first and second angle bottom bars while being contained within the first and second angle bottom bars;

the operational assembly curtain is secured to the bottom bar center flat section; and the bottom bar center flat section is fixed to the first and second angle bottom bars at each end.

2. The door system of claim 1 wherein the bottom bar center flat section is contained within a curtain bottom hem pocket.

3. The door system of claim 2 further comprising:

a plurality of first angle bottom bars, each pair joined with a respective first angle bottom bar connector a plurality of second angle bottom bars, each pair joined with a respective second angle bottom bar connector; and a plurality of bottom bar center flat sections, each pair overlapped inside of the curtain bottom hem pocket.

4. The door system of claim 2 further comprising multiple bottom bar center flat sections, each pair overlapped inside of the curtain bottom hem pocket.

5. The door system of claim 1 further comprising multiple operational assembly coiling curtains and counterbalance assemblies, each pair of operational assembly coiling curtain and counterbalance assembly separated by a respective coupler shaft fixed to a coupling curtain comprising the curtain bottom hem pocket, wherein all curtains are fixed to its adjacent curtain when the door system is in a smoke protective state.

6. The door system of claim 5 wherein a curtain is fixed to its adjacent curtain by hook and loop; the coupler shaft comprises a hook and loop separator channel and a coupling curtain cross brace; the coupler shaft is spring loaded; and all curtains are attached to the same bottom bar assembly.

7. The door system of claim 6 further comprising a horizontal support member.

8. The door system of claim 1 wherein the side geometry comprises a three piece guide and an operational assembly curtain L shaped retention member; the three piece guide comprising a fascia fastener attached to a fascia guide, and inner guide for attachment to a wall, and an outer guide fastener attaches an outer guide to the inner guide.

9. The door system of claim 1 wherein the side geometry comprises a two piece guide and an operational assembly curtain end lock; two piece guide comprising an outer guide and an inner guide; and the curtain end lock comprises a plurality of curved end locks.

10. The door system of claim 1 further comprising a curtain stop assembly.

11. The door system of claim 10 wherein the curtain stop assembly comprises a spring loaded pin and a spring loaded shaft stop mechanism.

12. The door system of claim 11 further comprising a curtain slot at a predetermined location to allow the spring loaded pin to extend through the curtain before the curtain fully unwinds.

13. A door system comprising:

a first and second operational assembly curtain, each comprising a respective bottom hem pocket;

the first and second operational assembly curtains separated by a coupler shaft fixed to a coupling curtain, the coupling curtain comprising the bottom hem pocket;

a respective counterbalance assembly fixed to each operational assembly curtain;

an operational assembly to operate a respective operational assembly curtain counterbalance assembly; and a bottom bar assembly;

wherein, the bottom bar assembly comprises:

a first angle bottom bar;

a second angle bottom bar; and a bottom bar center flat section therebetween;

the operational assembly curtain and coupling curtain are secured to the bottom bar center flat section; wherein the bottom bar center flat section is contained within the curtain bottom hem pocket;

the bottom bar center flat section is fixed to the first and second angle bottom bars at each end; and all curtains are fixed to its adjacent curtain when the door system is in a smoke protective state.

14. The door system of claim 13 wherein the bottom bar assembly comprises:

a plurality of first angle bottom bars, each pair joined with a respective first angle bottom bar connector a plurality of second angle bottom bars, each pair joined with a respective second angle bottom bar connector; and a plurality of bottom bar center flat sections, each pair overlapped inside of the curtain bottom hem pocket.

15. The door system of claim 13 further comprising multiple bottom bar center flat sections, each pair overlapped inside of the curtain bottom hem pocket.

16. The door system of claim 13 wherein a curtain is fixed to its adjacent curtain by hook and loop; the coupler shaft comprises a hook and loop separator channel and a coupling curtain cross brace; the coupler shaft is spring loaded; and all curtains are attached to the same bottom bar assembly.

17. The door system of claim 13 further comprising a horizontal support member.

18. The door system of claim 13 wherein the side geometry comprises a three piece guide and an operational assembly curtain L shaped retention member; the three piece guide comprising a fascia fastener attached to a fascia guide, and inner guide for attachment to a wall, and an outer guide fastener attaches an outer guide to the inner guide.

19. The door system of claim 13 wherein the side geometry comprises a two piece guide and an operational assembly curtain end lock; two piece guide comprising an outer guide and an inner guide; and the curtain end lock comprises a plurality of curved end locks.

20. The door system of claim 13 further comprising a curtain stop assembly.

21. The door system of claim 20 wherein the curtain stop assembly comprises a spring loaded pin and a spring loaded shaft stop mechanism.

22. The door system of claim 21 further comprising a curtain slot at a predetermined location to allow the spring loaded pin to extend through the curtain before the curtain fully unwinds.

23. A door system comprising:

a first and second operational assembly curtain, each comprising a respective bottom hem pocket;

the first and second operational assembly curtains separated by a coupler shaft fixed to a coupling curtain, the coupling curtain comprising the bottom hem pocket;

a respective counterbalance assembly fixed to each operational assembly curtain;

an operational assembly to operate a respective operational assembly curtain counterbalance assembly;

a horizontal support member;

a curtain stop assembly comprising a spring loaded pin and a spring loaded shaft stop mechanism; and a bottom bar assembly comprising:

a plurality of first angle bottom bars, each pair joined with a respective first angle bottom bar connector a plurality of second angle bottom bars, each pair joined with a respective second angle bottom bar connector; and a plurality of bottom bar center flat sections, each pair overlapped inside of the curtain bottom hem pocket;

wherein;

the operational assembly curtain and coupling curtain are secured to the bottom bar center flat section; wherein the bottom bar center flat section is contained within the curtain bottom hem pocket;

the bottom bar center flat section is fixed to the first and second angle bottom bars at each end;

all curtains are fixed to its adjacent curtain when the door system is in a smoke protective state by hook and loop; the coupler shaft comprises a hook and loop separator channel and a coupling curtain cross brace; the coupler shaft is spring loaded; and all curtains are attached to the same bottom bar assembly; and the side geometry comprises a two piece guide and an operational assembly curtain end lock; two piece guide comprising an outer guide and an inner guide; and the curtain end lock comprises a plurality of curved end locks attached to the operational assembly curtain.

* * * * *